United States Patent [19]

McCarthy et al.

[11] 4,248,356

[45] Feb. 3, 1981

[54] SEALING METHOD

[75] Inventors: Bruce L. McCarthy, Woollahra; Karl M. Dunn, Castle Hill, both of Australia

[73] Assignee: ACI Technical Centre Pty. Ltd., New South Wales, Australia

[21] Appl. No.: 574

[22] Filed: Jan. 2, 1979

[30] Foreign Application Priority Data

Jan. 9, 1978 [AU] Australia ..... PD2981
Sep. 15, 1978 [AU] Australia ..... PD5961

[51] Int. Cl.[3] ..... B29C 27/08; B29C 25/00; B29D 9/00

[52] U.S. Cl. ..... 215/344; 53/488; 215/DIG. 1; 264/23; 264/239

[58] Field of Search ..... 264/23, 320, 248, 239, 264/249; 156/69, 73.1; 215/DIG. 1, 232, 343, 344; 425/174.2; 53/416, 423, 485, 488; 220/DIG. 31

[56] References Cited

U.S. PATENT DOCUMENTS

| | | | |
|---|---|---|---|
| 3,232,470 | 2/1966 | Gibson | 215/DIG. 1 |
| 3,602,257 | 8/1971 | Berleyoung | 264/23 |
| 3,739,468 | 6/1973 | Hill | 264/23 |
| 3,773,205 | 11/1973 | Keeler et al. | 206/497 |
| 3,784,041 | 1/1974 | Birch | 215/DIG. 1 |
| 3,788,509 | 1/1974 | Keeler | 220/288 |
| 3,824,138 | 7/1974 | Karobath et al. | 156/580.2 |
| 3,874,635 | 4/1975 | Fletcher et al. | 251/333 |
| 3,911,074 | 10/1975 | Kessler | 264/23 |
| 3,920,503 | 11/1975 | Keeler | 156/58.2 |
| 3,947,307 | 3/1976 | Buchscheidt | 156/73.1 |
| 3,948,405 | 4/1976 | Yonker | 215/DIG. 1 |

FOREIGN PATENT DOCUMENTS

| | | | |
|---|---|---|---|
| 304348 | 3/1955 | Switzerland | 215/DIG. 1 |
| 1292451 | 10/1972 | United Kingdom . | |

OTHER PUBLICATIONS

Kish, "How To Ultrasonically Weld the New Engineering Plastics", Plastics Technology, Sep. 1972, pp. 40–42.

Obeda, Modern Plastics (11-1964) vol. #42, pp. 130–131, 132, 137 & 191.

*Primary Examiner*—W. E. Hoag

*Attorney, Agent, or Firm*—Stevens, Davis, Miller & Mosher

[57] ABSTRACT

The invention provides a method of improving the gastightness of a seal formed between two components consisting of a closure cap applied to seal a container. An ultrasonically vibrating horn is applied to the closure cap to heat the sealing surfaces of the closure cap and container. As the cap and/or container are formed of thermoplastic material, the ultrasonic heating softens the sealing surface of one of the components and causes it to mould into close conformity with the complementary sealing surface of the other component with the effect that the gastightness of the seal between the two is improved. The application of ultrasonic heating energy is discontinued before any significant welding between the two components can occur.

9 Claims, 6 Drawing Figures

SEALING METHOD

This invention relates to a method for improving the gastightness of seals between closures and containers and the invention is particularly applicable to the employment of ultrasonic techniques to improve the sealing characteristics of closure caps which have been applied to containers containing carbonated beverages.

Currently, large numbers of closures are manufactured from components which have been moulded in bulk from thermoplastic materials using conventional plastics moulding equipment. The tolerances achievable on most commercial plastics moulding equipment usually do not allow the consistent production of components which mate sufficiently well to provide an effective gastight seal which is consistently capable of retaining gas under pressure for long periods. This is because the effectiveness of the seal between the closure and container neck is reduced by minute moulding imperfections in both components with the result that the seal allows a degree of seepage of pressurised carbon dioxide therethrough. Thus the container contents can go flat and the shelf life of the package is reduced.

Applicants have now found that the known technique of ultrasonic welding can be modified to provide a method of improving the mating between closure caps and the containers which they seal.

As the name implies, the technique of ultrasonic welding involves the welding or joining together of different components by subjecting them to ultrasonic vibration, causing frictional heat to melt at least the abutting surfaces of the components, to cause them to merge and form a joint. The source of the ultrasonic vibration generally consists of an electrostrictive element which expands and contracts in response to an applied alternating voltage. Lead zirconate titanate is particularly suitable as the electrostrictive element. Horns, which are alternatively referred to as concentrators, rods, tools or amplitude or velocity transformers, are used to transfer the ultrasonic vibrations from the element to the welding components.

Sufficient ultrasonic energy is applied to melt or soften the surface of the closure cap or container neck so that the component material can flow to mould itself to the same shape as any minute unconformities or irregularities in the mating component. However, the ultrasonic energy input is stopped before the melting reaches the stage where any substantial degree of welding occurs at the seal.

The invention is largely directed to obtaining effective seals for packages containing carbonated beverages and does not cover the dispensing closures claimed by U.S. Pat. No. 3,400,866 to L. A. Fattori. It is noted that the Fattori style dispensing valves are manufactured from a resiliently distortable elastomeric material which is not ideally suited to retaining the pressure of carbonation.

More specifically, the invention provides a method of improving the gastightness of a seal formed between a closure member and a hollow neck member, said closure member including a circular panel portion with an integral tubular skirt portion depending therefrom, said tubular skirt portion being telescopically mounted on the hollow neck member and being secured thereto, said method including the step of subjecting the sealing surfaces of said closure member and hollow neck member which form said seal to sufficient ultrasonic vibration to cause the sealing surface of at least one of said members to melt or soften and flow, whereby to mould itself into conformity with the sealing surface of the other of said members, said application of ultrasonic energy being limited for a period sufficiently short to ensure that substantially no welding between said sealing surfaces occurs.

It is anticipated that in the majority of commercial instances, it will be the closure member sealing surface which is moulded to conform to the surface of container rim. However, the invention is also applicable to, and covers within its scope, the moulding of the neck member sealing surface to conform to the sealing surface of the closure member, particularly where the melting point of the neck member is lower than the melting point of the closure member material. For example, in the case where a metal closure cap has been applied to a plastic necked bottle, the ultrasonic vibrations may be applied through the closure to cause the sealing lip of the plastic bottle to soften and become moulded to conform to the metal closure cap.

The ultrasonic oscillation will most suitably be applied to the closure member by means of an ultrasonically vibrating horn which has been specially designed to suit the design of the closure member being used.

Preferably, the horn will be of hollow tubular configuration, in order that pressure can be exerted onto that region of the closure member which is in sealing contact with the neck member.

The horn, which is held against the closure, imparts ultrasonic energy to effect localised melting of the plastic in the sealing area between the closure member and bottle neck. Horn pressure may be maintained after melting by ultrasonic vibration has been completed to ensure that the molten plastic has sufficient time to flow and solidify in the required conformation.

As the operation of the invention is dependent on a wide range of interdependent parameters, such as closure design, melting point of the plastic of the closure, melting point of the container material, horn design etc., operating conditions for most situations can only be defined in very general terms. The following list gives typical ranges for some parameters in the application of the invention.

Typical figures are:

(i) Period of application of ultrasonic vibrations: in the range of 0.02 to 6 sec., more preferably 0.1 to 0.5 sec.

(ii) Holding time sufficient to allow components to solidify under pressure without application of vibrations: in the range of 0.05 to 3 sec., more preferably 0.05 to 1 sec.

(iii) Pressure of application of the horn to the members: 0.1 to 100 psig.

(iv) Amplitude of ultrasonic vibrations applied by a horn: 0.001 inches to 0.01 inches.

In cases where the closure member and the neck member are composed of different plastics with similar melting or softening temperatures, (e.g. a poly-ethylene terephalate bottle and a polyolefin closure) welding between the two components is unlikely as an undesirable side effect of the method of the invention despite the likelihood that the bottle material would tend to soften because of its low softening point, as the chemical incompatability of polyethylene terephalate and polyolefin would tend to prevent welding.

The invention will now be described in more detail with reference to the accompanying drawings, wherein.

Figure 1A:
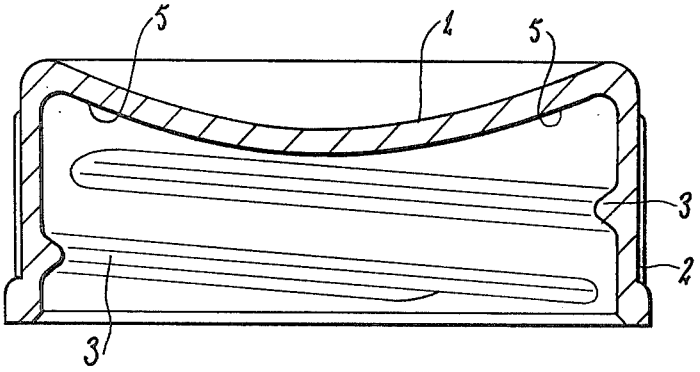
FIG. 1A illustrates a section of a linerless closure.

Referring to FIG. 1A, there is shown a cap formed of a thermoplastic material which may be manufactured by conventional manufacturing processes such as injection moulding. The cap comprises a circular panel portion 1, from which depends a tubular skirt portion 2. The skirt portion is provided with means such as the internal screw thread 3, to facilitate attachment of the cap to the neck of a container. Sealing means for facilitating sealing between the cap and a container are provided on the cap.

Figure 1B:
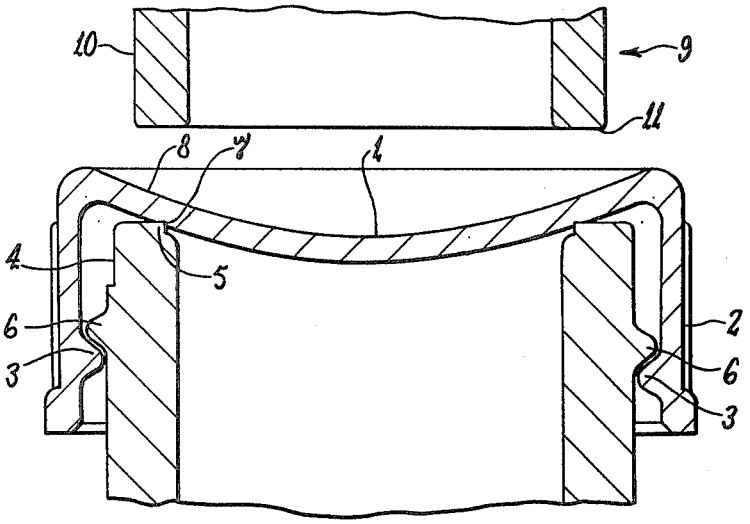
FIG. 1B illustrates the linerless closure of FIG. 1A applied to a container neck with an ultrasonic horn located thereabove.

In the illustrated embodiment, these sealing means comprise an annular region 5, around the surface of the underside of the convex panel which contacts the rim of a container neck when it is secured thereto. FIG. 1B shows a view of the contact between the top of a container neck 4 and an annular region 5 of the circular panel 1. The container neck includes a screw thread 6 which is complementary to the screw thread 3 of the closure cap and serves to hold the cap in sealing engagement with the neck.

An annular seal is obtained by the top of the round neck pressing up hard against the underside of the top panel at 5. The top of the neck may also be provided with a step 7, to improve the effectiveness of the seal between the neck and the cap.

A reciprocating horn 9, which is arranged for the transfer of ultrasonic energy from a source (not shown) is mounted in a position immediately above the concave circular panel portion 1 of the closure. The horn may comprise a hollow cylindrical member 10, which is chamfered at 11 to facilitate the ultrasonic moulding operation.

During operation, the horn can be moved from the position illustrated to a position where the chamfered end contacts the upper surface of the concave panel member 1 around an annular region 8 corresponding to the region 5 on the underside thereof. In this way, ultrasonic energy is applied to the sealing surfaces for a period of 0.04 to 1 second. The period of ultrasonic vibrational heating should be chosen to ensure that the sealing surface of at least one of the components softens sufficiently to allow it to melt or flow into mating conformity with the other of the sealing surfaces without forming a weld between the two components. The optimum heating time can be readily determined by standard trial and error procedures.

To minimise the risk of accidental welding, it is preferred that the respective sealing surfaces be formed of materials which are substantially incompatible for welding, and/or which have different melting points. Most advantageously, the melting point difference should be at least 10° C., although this is not essential, as it is even possible to achieve the type of moulding envisaged by the invention with component parts formed from the same materials, providing the process parameters are strictly determined and adhered to.

A further factor which affects the moulding is the pressure of application of the horn to the components, as care must be taken to ensure that the pressure is not so great as to cause welding where similar component materials are used or to cause gross distortion of the components. Generally, a pressure below 50 psig, more preferably below 20 psig, will be adequate, although this will again be dependent on the materials and construction of the components.

Finally, after the period of ultrasonic heating has ended, it may be necessary to maintain the pressure on the horn for a further 0.05 to 3 secs., more preferably about 0.4 secs., to allow the components to cool and set while they are held in place. The horn then retracts to its initial position as illustrated in the drawing in readiness for a repeat of the foregoing chain of operations.

However, where the closure cap is designed so that it resiliently maintains pressure on the sealing surface even after the horn has been removed, it may be possible to retract the horn as soon as the ultrasonic heating is completed.

Figure 2A:
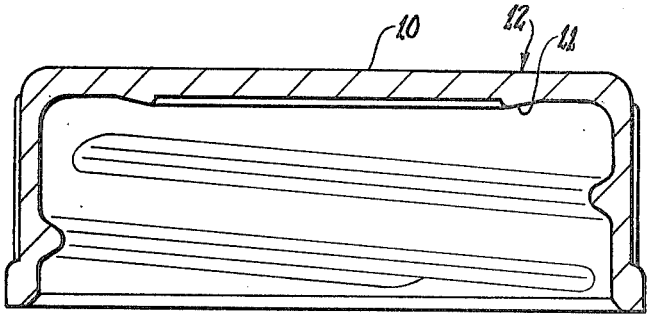
FIG. 2A illustrates a section of an alternative form of linerless closure.
Figure 2B:
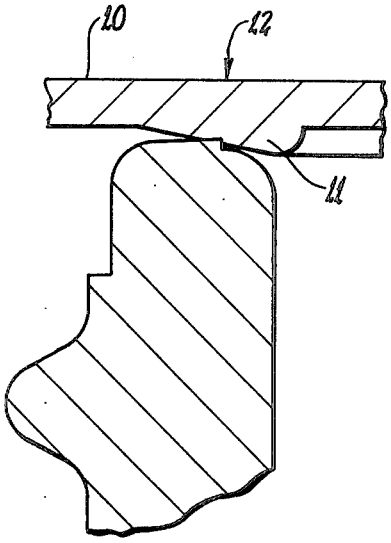
FIG. 2B illustrates an enlarged fragmentary section of the linerless closure of FIG. 2A as it would appear applied to a container neck.

The cap shown in FIGS. 2A and 2B performs in a manner analagous to that described with reference to FIGS. 1A and 2B. In place of the concave top panel of FIG. 1A, the closure is provided with a flat top 10, the underside of which includes an annular bulge 11, shaped to make sealing contact with the top of a container neck. An ultrasonic horn is applied at an annular region 12 on the top of the closure to produce the desired moulding and sealing effect. In this case, the horn may be a tubular member of the type shown in FIG. 1B, or it may take the form of a flat plate which is arranged to press on the flat top of the closure.

Figure 3A:
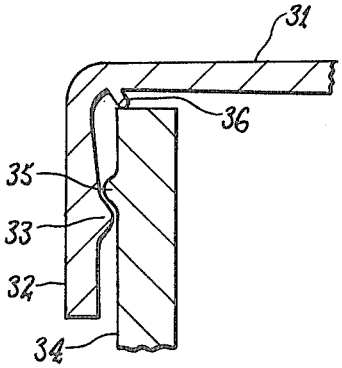
FIGS. 3A and 3B illustrate fragmentary sections of alternative forms of linerless closures secured to container necks.

The cap shown in FIG. 3A has a flat top panel portion 31 from which a tubular skirt 32, having screw thread means 33, depends. The cap is secured by the screw thread to the neck of a container 34, having a complementary screw thread 35. An integral annular fin 36 which is angled inwardly to make sealing contact with the lip of the container neck 34, if formed as an integral part of the panel portion 31. Application of ultrasonic energy through an annular region on the top panel of the closure opposite the fin on the underside thereof should have the effect of moulding the fin to give an improved sealing fit over imperfections in the container rim or the fin itself.

Figure 3B:
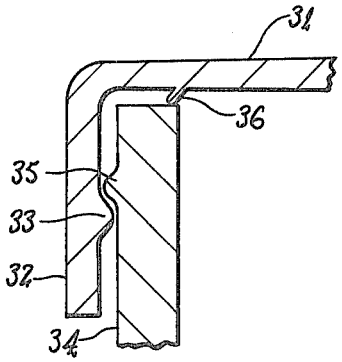

In FIG. 3B, a closure/container combination which includes the same reference numerals as shown in FIG. 3A for equivalent features, differs only from that of FIG. 3A in the arrangement and construction of the sealing fin. From the drawings, it can be seen that the sealing fin 7 flares outwardly to contact the container rim, rather than inwardly as shown in FIG. 3A. Thus the annular fin 7, must be located more towards the outer of the top panel 8, and the position of application of ultrasonic energy 9 must also be changed in accordance with this relocation.

Whilst the foregoing examples deal with application of ultrasonic energy to improve a single annular seal between closure and container, it is also possible to use the method according to the invention to improve the seal of a plurality of sealing surfaces between the closure and container.

We claim:

1. A method of improving the gastightness of an annular seal formed between a closure and a circular opening provided at the end of a hollow neck member of a container, said closure including a circular upper portion with an integral tubular skirt portion depending therefrom, said tubular skirt portion being telescopically mounted on the hollow neck member with said upper portion over said opening, said method including the steps of, (i) removably securing said closure to said neck whereby an annular sealing surface forming part of said closure bears upon a complementary annular sealing surface of said neck, (ii) pressing a horn down upon the upper portion of said closure, (iii) applying ultrasonic energy through said horn to cause localized softening or melting of at least one of said sealing surfaces, (iv) maintaining said horn pressure for a time sufficient to allow one of said sealing surfaces to flow and mold itself into conformity with the other sealing surface, (v) discontinuing said application of ultrasonic energy within a period which is sufficiently short to ensure that substantially no welding between said sealing surfaces occurs whereby said closure may be removed from said container without rupturing said sealing surfaces, (vi) removing said horn from pressing engagement with said upper portion.

2. The method according to claim 1, including pressing the horn down upon an upper portion of said closure having a circular top panel which is concave.

3. The method according to claim 1, including removably securing the sealing surface of said closure having an annular bulged portion formed on the underside of said circular panel portion to said neck.

4. The method according to claim 1, including removably securing the sealing surface of said closure having an annular sealing fin formed on the underside of said circular panel portion to said neck.

5. The method according to claim 1, including applying ultrasonic vibration for from 0.1 to 0.5 seconds through said horn.

6. The method according to claim 1, including holding said horn against said closure member for 0.05 to 1 second, after said ultrasonic vibration has stopped.

7. The method according to claim 1, including pressing a hollow tubular horn down upon the upper portion of said closure.

8. The method according to claim 1, including removably securing said closure member having resilient means for pressing the closure member sealing surface against the sealing surface of the hollow neck member.

9. A package including a container and a closure which has been sealed in accordance with the method of claim 1.

* * * * *